United States Patent [19]

Mason et al.

[11] 4,338,878

[45] Jul. 13, 1982

[54] FLUIDIZED BED WITH SLOPED APERTURE PLATE

[75] Inventors: Kenneth R. Mason, Wethersfield; Edward G. Day, Rocky Hill, both of Conn.

[73] Assignee: United Technologies Corporation, Hartford, Conn.

[21] Appl. No.: 210,482

[22] Filed: Nov. 26, 1980

[51] Int. Cl.[3] ..... B05C 19/02

[52] U.S. Cl. ..... 118/429; 118/DIG. 5; 427/185; 427/213

[58] Field of Search ..... 427/185, 213; 118/DIG. 5, 303, 309, 429

[56] References Cited

U.S. PATENT DOCUMENTS

| | | | |
|---|---|---|---|
| 2,648,609 | 8/1953 | Wurster | 427/213 |
| 2,844,489 | 7/1958 | Gemmer | 427/185 X |
| 3,097,958 | 7/1963 | Morris | 427/185 X |
| 3,567,485 | 3/1971 | Lemelson | 118/DIG. 5 |
| 3,581,802 | 6/1971 | Krzyzonowski | 164/34 |
| 3,799,112 | 3/1974 | Huteaux | 118/DIG. 5 |
| 3,832,974 | 9/1974 | Adams et al. | 427/185 |
| 3,963,838 | 6/1976 | Setty et al. | 427/213 |
| 4,265,296 | 5/1981 | Ostrowski | 164/165 |

FOREIGN PATENT DOCUMENTS

| | | |
|---|---|---|
| 1155883 | 10/1963 | Fed. Rep. of Germany . |
| 1255115 | 6/1961 | France . |

*Primary Examiner*—Shrive P. Beck

*Attorney, Agent, or Firm*—C. G. Nessler

[57] ABSTRACT

A fluidized bed has an aperture plate which is inclined to the horizontal, to cause excessively large or dense particles to migrate to a collection point from which they may be removed from the particulate mass. Disruption of fluid flow through the aperture plate due to settled out particles is thus avoided. Preferably the aperture plate is made of a material which has the same permeability as the fluidized mass, thus inherently providing flow regulation necessary for even fluidization above the slope plate. To make investment casting molds, a gravity "rainsander" device is coupled with a fluidized bed. When slurry used in the mold making process drips from a pattern it falls into the fluidized bed thereby converting the errant drops into particulate balls which are conveniently removed.

8 Claims, 5 Drawing Figures

FLUIDIZED BED WITH SLOPED APERTURE PLATE

DESCRIPTION

Background Art

1. The present invention relates to fluidized bed construction, and to other apparatuses usable for contacting particles with a solid object, most particularly those apparatuses adapted for contacting liquid coated objects with ceramic particles, to create ceramic layers thereon.

2. A fluidized bed is an apparatus wherein particles resting in a container are agitated or fluidized by the controlled passage of air or other gas from an aperture plate which forms the bottom of the container. Fluidized beds have a variety of uses, but the present invention solves problems which occur when fluidized beds inadvertently contain particles of greater mass or dimension than the particulate mass which is being fluidized. In such instances, the larger particles migrate to and settle on the aperture plate and ultimately block gas flow and upset fluidization of the bulk of the bed.

One instance in which the foregoing problem arises is in the formation of investment casting molds. In this process the hollow mold is made from particles by repetitively coating a wax pattern with slurry, and then before the slurry dries contacting ceramic particles with the slurry wetted surface so that they adhere. After the slurry solidifies, usually by drying, the pattern is again coated with the slurry and particles. The slurry is typically an aqueous mixture of fine ceramic particulate and a binder, such as a colloidal silica or sodium silicate. The process is repeated in like manner until a layer of shell is built up around the pattern. After the desired thickness of ceramic is obtained on the wax pattern, the pattern is melted out. The mold is typically then dried and fired at an elevated temperature to drive off residual water and cause sintering whereupon it is ready for use.

The use of a fluidized bed makes contact of the particles with the wet pattern easy. However, any excess slurry on the pattern which drips off into the fluidized bed will be converted into an agglomeration of particulates, or a "slurry ball" which dries and, owing to its greater mass, sinks to the bottom of the bed and thereby disrupts the flow from the aperture plate. Thus, when the equipment is sought to be adapted to continuous or automated production, the control of variables which is important for reproducibility is complicated, and constant cleaning of slurry balls from the particulate must be undertaken.

Another device which is used in company with or substitution for the fluidized bed system is designated the "rainsander". This is essentially a device which causes sand to drop through a space, typically by force of gravity, from a discharge point into a receiving container. For continuous operation over a period of time the sand entering the container is conveyed back to the discharge point. The rainsander is at times preferred compared to the fluidized bed, because of the more gentle action of the sand as it contacts the pattern. However, one of the difficulties with the rainsander is that slurry balls and agglomerations of slurry can also occur in the receiving receptacle and thereby interfere with its operation.

To summarize, in both instances the dripping of excess slurry from the shells as they are being coated causes problems of cleaning and associated down time. In the fluidized bed the small hardened balls drop to the horizontal aperture plate and cause blockage of the air flow. In the rainsanders the drips adhere to the lower hopper and accumulate to the point where they impede particulate recovery. Thus, there is need for improvements in these types of devices.

DISCLOSURE OF INVENTION

An object of the invention is to provide a fluidized bed which eliminates the adverse effects of unwanted large particles and provides for their easy removal. A further object is to provide apparatus for uniformly contacting particulates with wet slurry coated objects, the apparatus tolerating dripping of slurry thereinto.

In the invention a fluidized bed has an aperture plate which is inclined to the horizontal so that excessively sized or dense particles migrate to a collection point from which they may be removed, such as by a gate in the side of the bed. Coupled with the inclined plate are means for regulating fluidizing gas flow, so that fluidization is relatively uniform. Since the bed is shallower where the aperture plate rises from the horizontal, the flow at such locations is reduced from that which would occur if the pressure at the upper surface of the aperture plate were uniform, as is characteristic of common fluidized beds.

In a preferred embodiment the aperture plate is a porous wedge-shaped ceramic. The permeability of the ceramic is chosen to be similar to that of the fluidized bed, and thus uniform fluidization is achieved across the horizontal plane of the bed. In this approach the pressure and flow regulating means is integrated in the plate. In other embodiments, sub-plates may be used to balance flow.

In further accord with the invention, a rainsander is coupled with a fluidized bed which receives the "raining sand". Any slurry which falls from a pattern during investment mold making is converted into slurry balls which may then be removed when the fluidized bed is provided with a sloped aperture plate. With regulating valves and controls the combined rainsander and fluidized bed is suited for use in various modes and automatic production.

The foregoing and other objects, features and advantages of the present invention will become more apparent from the following description of preferred embodiments and accompanying drawings.

BEST MODE FOR CARRYING OUT THE INVENTION

The preferred embodiment of the invention is described in terms of the formation of a ceramic mold for investment casting. However, the invention will be seen to be usable in other applications where a fluidized particulate mass is being handled and where the formation of agglomerations or the inclusion of other extraneous unfluidized matter is disruptive to operations.

In the practice of the invention a fluidized bed container is filled with a mass of zircon powder having a nominal U.S. Sieve Size mesh varying from 180 to less than 325 mesh to an average depth of about 560 mm. When making ceramic investment shells using the aforementioned particles, the pattern is coated with a slurry of very fine ceramic powder, water, and colloidal silica. When a pattern is translated over the fluidized bed, after having been dipped in slurry, from time to time excess slurry drips into the fluidized bed particle mass, where it immediately intermixes with fine particulate. Particles will adhere to droplets of slurry and commence drying to form agglomerations, roughly spherical-like balls, of from 3 to 6 mm diameter. The size of these balls is such that they will not be supported by the air flow which satisfactorily supports the zircon particle mass and they sink to the bottom. In the use of the prior art horizontal aperture plate apparatus, after a period of time dimunition in air flow through the fluidized bed would occur. This made insertion of patterns into the now partially fluidized mass increasingly difficult, and ultimately results in breaking of the patterns due to excess resistance. When a significant dimunition in flow was observed, it was previously necessary to remove the particle mass from the bed, to screen it and remove the large slurry balls from it. As will be seen, our invention will be useful for removing not only large particles, such as slurry balls, having similar density to the fluidized particles, but also for removal of particles which are of similar size but of excess density, as may occur in other applications.

Figure 1:
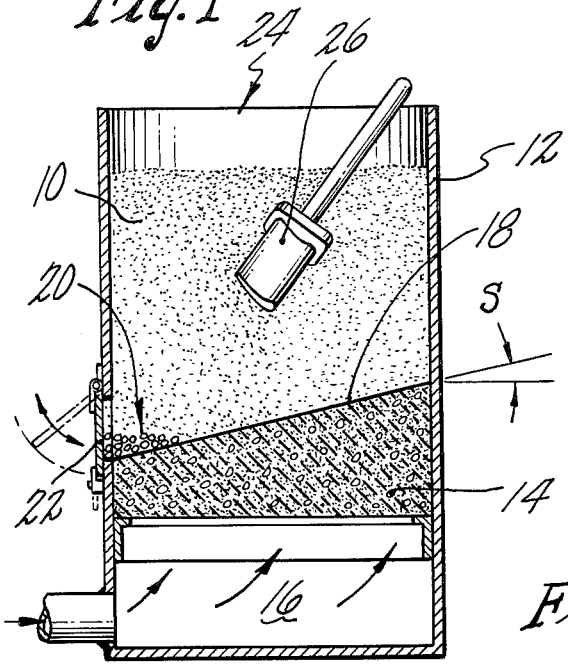
FIG. 1 shows a fluidized bed with wedge-shaped porous ceramic aperture plate having a sloped upper surface.

FIG. 1 shows a fluidized bed in accord with the invention. A mass of particles 10 having desired physical characteristics is held within a container 12 which has an aperture plate 14 at its bottom. The fluidizing gas, such as air is introduced into a plenum 16 beneath the aperture plate 14 which is fastened within the container. The aperture plate is made of a porous ceramic material, such as Filtros sintered ceramic plate (Ferro Corporation, East Rochester, NY). The permeability of the aperture plate is by design similar to the permeability of the particulate mass 10, as set forth in more detail below. The upper surface 18 of the aperture plate is sloped at an incline angle S from the horizontal plane 20. Accordingly when larger particles, having a mass or size greater than can be maintained in suspension by the fluidization air, they gravitate to the plate surface 18, whereupon, due to the slope they will by further force of gravity flow to a collection point 20 where a quantity of large slurry ball particles 21 are shown in the drawing of FIG. 1. The container 12 is fitted with a gate valve 22 which may be opened periodically to permit discharge of the large particle slurry balls, together with a small quantity of intermixed zircon particles. The container has an open top 24 which provides access for a slurry coated pattern 26 and dipping thereof into the fluidized bed to cause particles to contact and adhere to the pattern and ultimately form a mold shape.

The incline S of the surface of the aperture plate is chosen to be that which experience shows is adequate to cause the large unwanted particles to flow to the collection point. A slope on the aperture plate of about 17° from the horizontal was adequate to cause the slurry balls to flow to a collection point at the side of the container. Of course a greater angle could be used, but too great an angle increases the cost and difficulty of manufacture of the aperture plate, and ultimately results in the fluidized bed being unduly shallow at the location above the high end of the plate. We believe that for most applications, based on our experience, that the incline of the plate should be greater than 15°, but less than 60°, and most preferably 17°.

As noted, the slurry balls flow to the collection point 20. At that vicinity, they do of course tend to disrupt the flow of air through the plate. However they are relatively concentrated and therefore the disruption is small. And the major advantage of our invention is that when any significant disruption is noted, opening of the valve 22 for a short period suffices to remove the balls from the container. In a production application, the accumulation of slurry balls will be more or less predictable, and therefore the removal of the large particles may be programmed according to the production rate. Once the slurry balls and particulate mix are removed from the container, they can be conveniently processed by means of screens, in our case 180 mesh screens, to recover the finer particles and which may be re-introduced into the fluidized bed.

Figure 2:
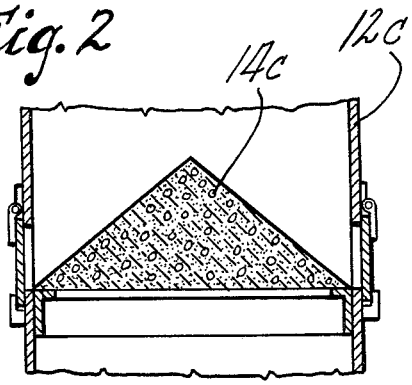
FIG. 2 shows a porous plate usable in the apparatus of FIG. 1, having a double sloped upper surface.
Figure 3:
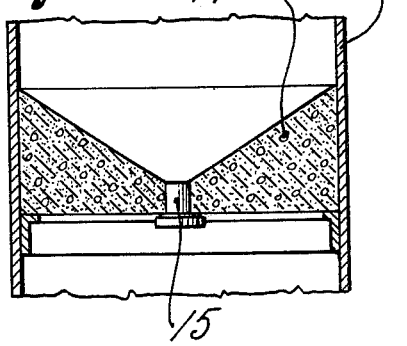
FIG. 3 shows another plate, similar to FIG. 2, but with a convex conical upper surface.

In our practice of the invention the container was circular with a diameter of about 610 mm, the depth of sand in the fluidized bed varied between 430 mm at the deepest point and 250 mm at the shallowest point. The thickness of the filter plate varied from 13 mm at its thinnest point to 190 mm at its thickest point. Of course, other shape containers may be used. For the valve 22 a hinged flap-type valve is preferred, but many common sliding, pinching, hinged types of valves and other closable devices suited for particulates may be used instead. In the preferred embodiment the upper surface of the aperture plate has a single upper plane at the angle S and a horizontal lower plane. However, it should be apparent that the lower surface need not be horizontal, and that more complex upper surfaces may be used to suit the particular user. For example, the upper surface may be comprised of two intersecting planes, each having a slope S as shown in FIG. 2; or it may be comprised of a concave cone with an angle S as illustrated by FIG. 3, or of a multiplicity of other planes or channels, and instead of there being one collection point there may be several. Such more elaborate constructions may be desirable in larger fluidized beds.

Figure 4:
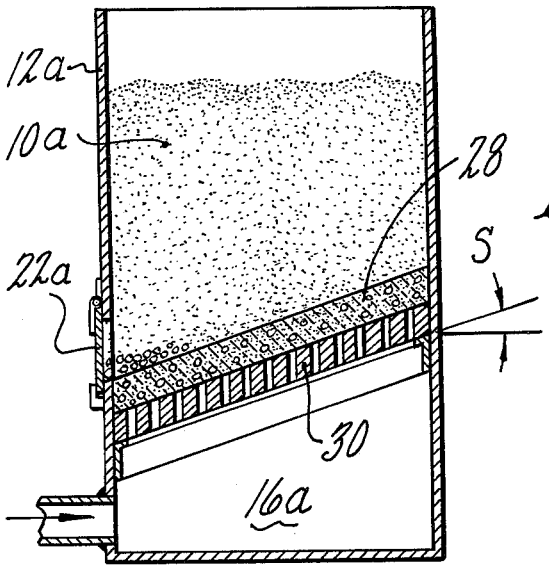
FIG. 4 shows a fluidized bed with sloped porous aperture plate made of porous material of unitary thickness, together with a second lower aperture plate which regulates flow.

FIG. 4 shows an alternative embodiment of the invention. The container **12*a* is filled with a particle mass 10*a*. A first aperture plate 28, comprised of a porous sintered ceramic material, is mounted on a second aperture plate 30 and both are secured within the container 12*a*. The upper surface of the plate 28 is inclined at an angle S to provide a configuration and function similar to that just described. The second aperture plate 30 has a series of varying diameter holes, with the smaller diameter holes being placed at the end which is disposed at a greater height with respect to the horizontal. The different diameter holes are selected to restrict the flow in a greater degree at the higher end of the plate where the depth of the fluidized bed above the plates is less. This has the effect of delivering a lower pressure to the elevated end of the first aperture plate 28, compared to that which is delivered to the lower and deeper end of the plate. The size of the holes is chosen, so that in combination with the permeability of the first aperture plate and the fluidized bed, the flow through the fluidized particle mass, as measured across the horizontal plane, is relatively uniform, the uniformity desired being that which is required to produce a fluidized mass of relatively uniform behavior without surges of air or "dead spots" without fluidization. The first aperture plate 28 may be dispensed with in some situations, such as if the size of the particles is sufficient, with respect to the holes in the second aperture plate, so that excess loss of material through the holes into the plenum 16***a* is not encountered. But we prefer to have the aperture plate 28 in place, since the porosity of the plate, similarly to that of the embodiment of FIG. 1, is such that when the sand fluidization is stopped, the combination of pore diameter and torturous path through the ceramic is such that particles will not pass into the plenum.

Thus, in both the embodiments of FIGS. 1–4 it can be seen that the aperture plate must have a character which is sufficient to support the sand when it is not fluidized and prevent its passage downward into the air plenum. Porous ceramic materials are favored for aperture plates because of their relatively low cost, durability, and other properties associated with ceramics. However, other plates may be used, including but not limited to metal powder plates, metal screens, perforated and drilled plates, and the like. While the upper surface of the aperture plate must be such that particles which are not fluidized will not pass through the plate, there is not similar requirement for the underside of the aperture plate. It can be seen that the second aperture plate 30 in FIG. 4 is in essence a flow distributor and regulator. The second aperture plate can thus be replaced with other means, such as a series of baffles and chambers which are designed to deliver to the underside of the aperture plate which supports the fluidized bed an air flow which is balanced in pressure, so that the flow objectives for a uniform fluidized bed in the varying depth bed of our invention is achieved. It may be said in a similar vein that the preferred aperture plate of our FIG. 1 embodiment has the flow control means integrated within itself. Referring again to the FIG. 1 embodiment, the choice of a plate having a permeability equal to that of the particle mass means that there will be a greater pressure drop through the plate at the thicker regions, because the flow losses are a function of the distance travelled through the torturous passages of the plate. Thus, the pressure at the surface of the aperture plate is varying, according to the height of sand above the plate surface, and is automatically correct, regardless of the choice of slope. Naturally, in both our described embodiments the total fluidization of the particle mass in the bed is controlled by the total flow and pressure of the air supply.

As mentioned, for a monolithic plate of porous material the permeability is chosen equal to that of the fluidized particle mass. This choice permits a plate with a horizontal lower surface and any design of upper surface, since variation in thickness of the plate at any point will not alter the flow. In the example of zircon sand, the method used to ascertain the desired equivalence between bed and plate material was as follows. The porosity of the bed was determined by measuring the pressure drop necessary to cause incipient fluidization of a unit volume of particulate, with several heights of volumes being tested. The unit pressure per unit height which is essentially the bulk density of the particulate, was 0.341 lb. per cu. in. ($1.23\times10^{-5}$ kg/m$^3$). This was divided by the particle (material) density of 0.1 lb. per sq. in. (2.8 g/cm$^3$) to determine the porosity of the fluidized mass at 34%. The ceramic plate obtained from Filtros had a measured porosity of 33.7%. And of course substantially all the pores were open so that the pressure drop per unit length through the aperture plate was very close to that in the fluidized bed. While a sintered plate is of course preferred, it is also feasible to form the aperture plate of close packed unbonded particulate captured between suitable porous retaining diaphragms, provided the particulates do not on agitation blind passage of air through the pores of the retaining diaphragms.

Figure 5:
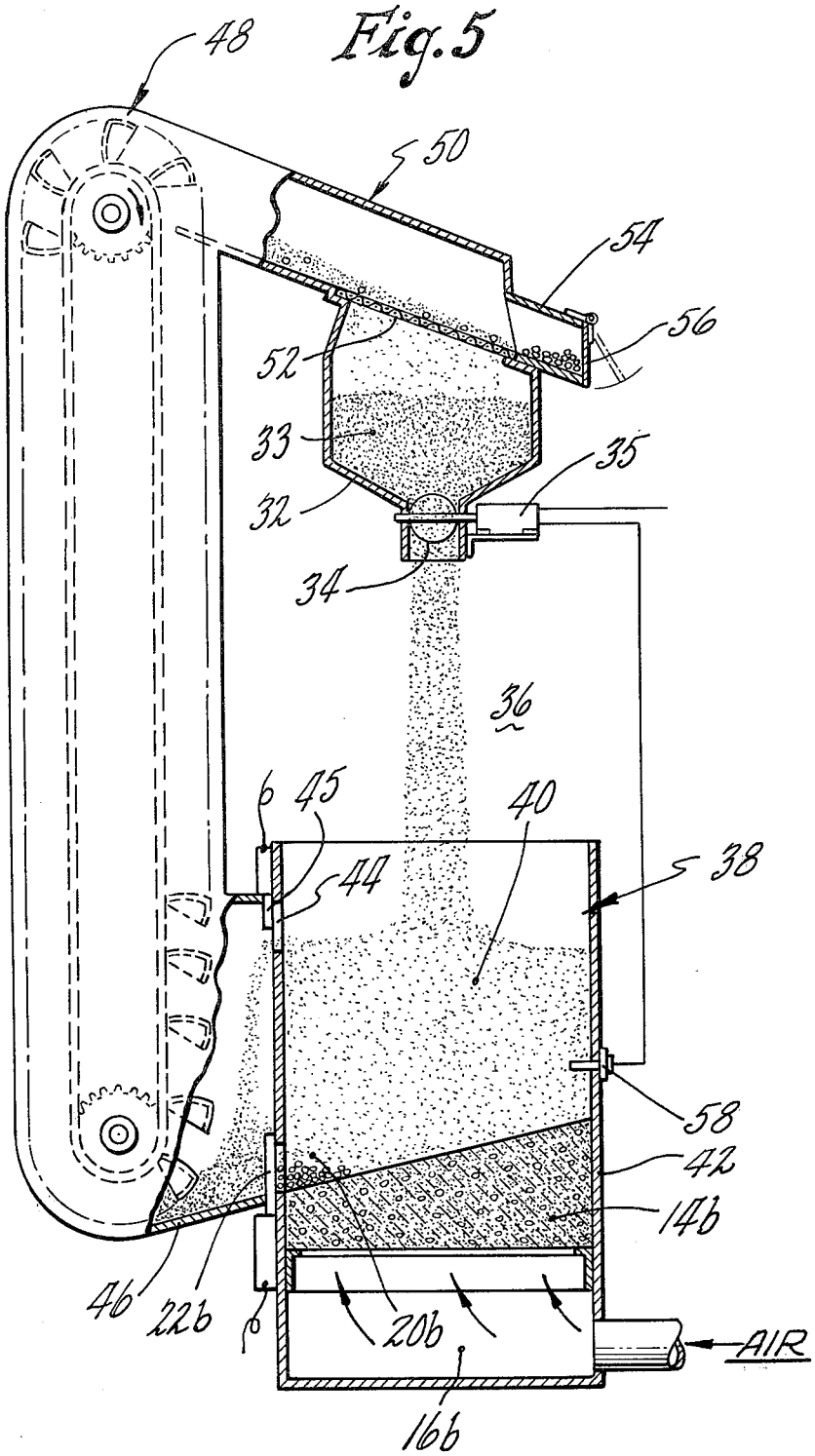
FIG. 5 shows a rainsander in combination with a fluidized bed.

FIG. 5 shows our invention applied to a rainsander. The rainsander is comprised of a storage hopper 32 in which a reservoir of sand (ceramic particles) 33 is maintained. The flow of sand from the container 32 is regulated by the valve 34. When discharged through the valve 34, the sand flows by force of gravity through a space 36 to the receiving container 38, which is a modification of our just described fluidized bed. To describe the container 38 in more detail, a mass of particles is constantly sustained within the walls 42. The fluidized bed has a plenum 16*b*, a tapered ceramic plate 14*b* with an inclined upper surface and a discharge valve 22*b* for large particles from the collection point. The receiving container 38 further has another opening 44 fitted with upper valve 45 at the desired level to which the fluidized particles are to be maintained. Both the opening 44 and the discharge valve 22*b* communicate with a lower channel 46 connected to the bottom of a bucket conveyor 48. The bucket conveyor discharges the contents of buckets into an upper channel 50 which conveys particles toward the storage hopper 32. Mounted just above the storage hopper 32 is a screen 52, sized to permit the passage of fine ceramic particles, but to impede the passage of large agglomerates, slurry balls and the like. The screen 52 communicates with an oversize particle discharge chute 54 and associated discharge gate 56.

In usual operation the bucket conveyor 48 is run continuously and air is introduced continuously into the plenum 16*b* to provide fluidization to the desired particle mass 40. When needed to coat a pattern, sand is discharged from the storage hopper 32 through the valve 34 and caused to fall through the space 36, to impinge on the surface of the fluidized particle bed in the receiving vessel 38. As sand accumulates in the fluidized bed it will reach the level of the upper discharge port 44 and if valve 45 is open, thereafter flow through the lower channel 46 to the bottom of the bucket conveyor 48 whereupon it will be lifted and discharged into the upper channel 50 and thus returned to the storage hopper.

Alternatively, the upper discharge port valve 45 may be automatically operated to maintain the desired fluidized bed level. The level of the sand 40 in the bed is determined by the discharges allowed by valves 45 and 20*b*, and the inflow permitted by valve 34 on the storage hopper. For automatic operation a sensor 58, such as an ultrasonic device or other common bin level indicator, may be applied to the container 38. The sensor, preferably through a suitable microprocessor, can be used to control one or all the aforementioned valves and maintain the desired level of sand in the bin in response to changing conditions.

When a slurry coated wax pattern is placed within the space 36 the particles flowing therethrough will impinge on the pattern and adhere to the wet and sticky surface, thereby forming the desired ceramic particle coating on the pattern. If some excess slurry drips from the pattern it will fall into the surface of the fluidized particle mass 40 and form a slurry ball agglomeration which due to its larger size and mass will sink to the bottom of the fluidized particle mass and thereafter move to the collection point 20*b*. Periodically the discharge gate 22*b* will be opened to allow the slurry balls and some of the particulate mass to be discharged or concurrently with the previously described coating operation and the flow of material through the upper discharge channel 44. This mix of fine sand particles and slurry balls will be carried by the conveyor to the upper channel 50. When the mixed particles pass over the screen 52 the slurry balls will be retained thereon, and by virtue of the incline of the screen or other means such as vibration, caused to flow to the discharge chute 54 for ulimate removal and disposal through the discharge gate 56. Accordingly, the combination of the fluidized bed with the rainsander is effective in preventing the accumulation of hardened debris and the like which would otherwise result in the event a receiving hopper of the ordinary type were used. In such an ordinary device the slurry dropping with the particulate would impact on a metal surface and adhere thereto, ultimately accumulating and necessitating arduous cleaning.

Although this invention has been shown and described with respect to a preferred embodiment, it will be understood by those skilled in the art that various changes in form and detail thereof may be made without departing from the spirit and scope of the claimed invention.

We claim:

1. A fluidized bed apparatus adapted to contain a mass of fine particles having desired characteristics, characterized by an aperture plate with its upper surface postioned at an incline with respect to a horizontal plane, the incline sufficient to cause undesired particles, which because of their size or mass tend not to be fluidized within the desired fine particles, to migrate to a collection point from which they may be removed from the apparatus; and means for regulating the flow through the aperture plate, the means providing a fluid pressure at the upper surface of the aperture plate which varies according to the height of particles containable above the plate, so that fluidization in the horizontal plane of the fluidized bed is relatively uniform.

2. The apparatus of claim 1 wherein the means for regulating the flow is a wedge-shaped porous mass having a permeability substantially equal to that of the particulate mass.

3. The apparatus of claim 2 wherein the wedge-shaped porous mass is a sintered ceramic plate, the lower surface of which is horizontal.

4. The apparatus of claim 1 or 2 wherein the surface is inclined at an angle of 15° to 60° with the horizontal plane.

5. The apparatus of claim 1 wherein the particulate is a ceramic material and the fluidized bed is adapted to receive a slurry-coated wax pattern.

6. The apparatus of claim 1 wherein the means for regulating the flow is comprised of a second aperture plate mounted beneath the first aperture plate, the second aperture plate having a series of varying diameter holes.

7. Apparatus for applying particles to an article comprising means for discharging particles, to enable them to fall freely through space by action of gravity; a fluidized bed for receiving the falling particles; and means for conveying the particles received in the fluidized bed container to the means for discharging particles; the fluidized bed apparatus having an aperture plate with its upper surface sloped at an incline with the horizontal plane, to cause particles which are not fluidizable to migrate to a collection point from which they may be removed from the apparatus, the bed further having means for regulating the flow through the aperture plate, the means providing a fluid pressure at the upper surface of the aperture plate which varies according to the height of particles containable above the plate.

8. The apparatus of claim 7 wherein the fluidized bed has a valve for discharging non-fluidizable particles from the collection point.

* * * * *